United States Patent [19]

Plateau

[11] 4,444,585

[45] Apr. 24, 1984

[54] PROCESS FOR PRODUCING METALS IN A VERY HIGH STATE OF PURITY IN RESPECT OF EUTECTIC ELEMENTS

[75] Inventor: Jean Plateau, Grenoble, France

[73] Assignee: Pechiney, France

[21] Appl. No.: 478,785

[22] Filed: Mar. 25, 1983

[30] Foreign Application Priority Data

Mar. 31, 1982 [FR] France ..... 82 05895

[51] Int. Cl.[3] ..... C22B 7/00

[52] U.S. Cl. ..... 75/63; 75/68 R

[58] Field of Search ..... 75/63, 68 R

[56] References Cited

U.S. PATENT DOCUMENTS 3,211,547 10/1965 Jarrett et al. ..... 75/68 R
4,043,802 8/1977 Esdaile et al. ..... 75/63
4,373,950 2/1983 Shingu et al. ..... 75/68 R

*Primary Examiner*—M. J. Andrews
*Attorney, Agent, or Firm*—McDougall, Hersh & Scott

[57] ABSTRACT

The present invention relates to a process of segregation for producing metals such as aluminum in a very high state of purity in respect of eutectic elements. The process comprises adding to a metal which is already very pure, at least one eutectic element, in a hypoeutectic amount, to ensure efficiency of the segregation operation. The added element or elements must be capable of being easily eliminated in the segregation operation, and it must not create difficulties in regard to the use envisaged for the metal.

This process can be used in particular for the production, with a suitable yield, of aluminum containing less than 10 ppm of iron and silicon, and intended in particular for the manufacture of high and medium voltage capacitors.

10 Claims, No Drawings

PROCESS FOR PRODUCING METALS IN A VERY HIGH STATE OF PURITY IN RESPECT OF EUTECTIC ELEMENTS

BACKGROUND OF THE INVENTION

The present invention relates to a process employing segregation for producing aluminum or other metals in a very high state of purity in respect of eutectic elements.

With particular reference to aluminum, it is known that it is possible to reduce the proportion of elements which are referred to as eutectic elements such as copper, iron, magnesium, silicon and zinc in aluminum, when such elements are in a state of hypoeutectic concentration. To achieve this, the metal is melted in a container, and subjected to a segregation operation. In the course of this operation, cooling causes the production of crystals which are more pure in respect of eutectic elements than the liquid within which the crystals are formed. The crystals collect by gravity at the bottom of the container as they are formed and, by their being compacted, the result is a more or less compact, purified solid, the purity of which has a tendency to drop depending on the amount of mass crystallized. The operation is generally continued until only a small fraction of the mother liquor remains. Then, by different means, for example by means of sawing operations which are carried out after cooling, it is possible to separate the purified mass from the remaining mother liquor, or to even separate the purified mass into a number of fractions in different states of purity.

The efficiency of the purification operation is generally indicated by the value of the purification coefficient $C_O/C_S$, in which $C_S$ is the concentration of a given impurity in the pure product obtained, and $C_O$ is the concentration in respect of the same impurity in the metal used. The higher the purification coefficient, the more efficient is the treatment.

Processes based on that principle are disclosed in U.S. Pat. Nos. 3,303,019 and 4,221,590, and in French Pat. No. 1,594,154. These processes enjoy purification coefficients and yields which are higher or lower depending on the particular means employed.

Thus, in U.S. Pat. No. 3,303,019, the starting material used is a metal containing 280 ppm of iron and 420 ppm of silicon, and the process recovers therefrom 32% of the starting metal mass which fraction contains only 30 ppm of silicon and 10 ppm of iron. This corresponds to purification coefficients of 14 in regard to the silicon and 28 in regard to the iron, with a yield of 32%.

In U.S. Pat. No. 4,221,590, which is for an improvement in the above-mentioned process, the process may improve the yield in respect of purified metal having a silicon content of close to 100 ppm but, in contrast, the proportion of the same element scarcely falls below 20 ppm, for the purest fraction of aluminum, which represents only about 30% of the mass used.

As regards French Pat. No. 1,594,154, starting from a metal containing 320 ppm of silicon and 270 ppm of iron, the results obtained are respective amounts of 20 and 15 ppm, corresponding to purification coefficents of 16 and 18. These values are already very high if account is taken of the substantial yield achieved since it is of the order of 70%. Alternatively, taking a metal containing 620 ppm of silicon and 550 ppm of iron and with a yield of 50%, the process gives a metal containing only 40 and 10 ppm, respectively, of those elements, which is equivalent to purification coefficients of 15.5 and 55. The latter values are markedly higher than that set forth is U.S. Pat. No. 3,303,019, particularly when it is noted that the yield is 50% instead of 30%.

However, for some particular uses, it has been found necessary to provide aluminum in an even higher state of purity than that achieved with the above-described processes. Thus, for example, for producing medium-voltage and high-voltage electrolytic capacitors, manufacturers are increasingly having recourse to sheets of aluminum in which the proportion of Si and Fe must be only a few ppm, although the presence of certain elements such as copper may attain markedly higher levels of concentration, without thereby giving rise to problems.

In order to achieve such levels of purity, it is possible, when using the process of the French patent, to select the purest fractions, that is to say, those which are formed at the beginning of the operating procedure, but it is found that the recovery yield is then very low, being of the order for example of 10%, approximately, of the amount of metal used.

The attempt has then been made to apply the segregation process to a metal which has already been subjected to a first purification step, either by segregation or by another process such as refining by electrolysis in three layers.

However, serious difficulties were encountered in performing the operating procedure. It is found in fact that, with metals which are already very pure, the liquid has a tendency to solidify in masses of large volume on the walls of the settling apparatus and even of the crucible. That runs counter to the desired aim since French Pat. No. 1,594,154 states that, in order to achieve efficient purification, it is necessary to seek to achieve solidification of the material in the form of small crystals in order to limit the amount of mother liquor that the crystals retain between themselves. It is highly probable that this difficulty arises out of the fact that, the higher the level of purity of a metal, the smaller is the solidification gap (the temperature difference between the liquidus and the solidus of the equilibrium diagram).

SUMMARY OF THE INVENTION

This application relates to means for remedying the difficulties resulting from the operating procedure in a process for segregating metals having a relatively high level of purity, thus improving the degree of purification, while maintaining a high yield. The process of the invention achieves, in particular, a state of purity of at least 99.8% in respect of eutectic elements.

This process for producing metal such as aluminum in a very high state of purity in respect of eutectic elements comprises subjecting a metal which is already very pure to a segregation operation. Prior to the segregation operation, however, and in order to make the segregation operation more efficient, at least one eutectic element is added to the molten metal, in a hypoeutectic amount, which is either very completely eliminated in the course of that operation or remains in the purified product in a proportion which does not cause difficulties for the use envisaged.

DETAILED DESCRIPTION OF THE INVENTION

The process of the invention uses an aluminum of other metal which is already very pure, for example which has already been subjected to a first purification operation which permitted its content of total impurities to be reduced to 200 and even 100 ppm or less. In the case of aluminum, the aluminum may contain, for example, a proportion of each of the elements iron and silicon, that is close to 50 ppm, but proportions which are higher or lower than that value in respect of any one of the impurities are also possible.

The first purification effect may be achieved for example by a segregation operation that is identical to the operation described in the above-quoted French patent. The starting metal may also have been subjected to a treatment for removing the peritectic impurities such as titanium and vanadium, for example.

Such a metal is then melted and at least one eutectic element is added to the liquid, in the absence of any crystallization. The eutectic element is preferably selected from the group comprising iron and copper but it is also possible to add these two elements simultaneously. What is important is that the eutectic element added must not be of a troublesome concentration after the final segregation operation. Thus, it is possible to add an element which has a very high purification coefficient, so that it can be easily removed when the process is performed. It is also possible to add an element having a lower purification coefficient provided that it does not have any harmful influence, even if it remains at a high level of concentration. In the former case, it is possible to add iron, the coefficient of which is close to 30. In the second case, it is possible to use copper which has a coefficient of about 7 but which, up to proportions of 50 ppm, does not give rise to difficulties in certain uses and which can be beneficial when the aluminum is intended for the production of medium and high voltage electrolytic capacitors. It will be apparent that it is possible for the elements iron and copper to be added simultaneously.

The amount of the element or elements added must obviously be such that the concentration in the liquid before crystallization is lower than that of the eutectic, as otherwise, as the liquid-solid equilibrium diagrams show, the crystals produced will at first be more impure than the initial mother liquor, which will then be followed by the deposit of crystals which are of a eutectic composition, and there will, therefore, be no possibility of purification.

However, the above-indicated amount added must not be too small, as otherwise the effect of the addition of that element will not fulfill the desired purpose, namely, to prevent mass crystallization which does not permit the operation to be suitably carried into effect. The addition operations will depend on the element added and the use for which the purified metal is envisaged. For example, in the case of iron, it is appropriate to add amounts of from about 100 to 200 ppm, and even 500 ppm. In the case of copper, however, the amounts added may be above 100 ppm and may be up to 2000 ppm if the aluminum is intended for example for the manufacture of capacitors.

The proportions indicated above are set forth only by way of example, as they depend on the manner in which the segregation operation is carried out, in particular in regard to the duration thereof.

The eutectic element may be added either in the solid state, or in the liquid state, and in any suitable form such as in the form of a pure element, in the form of an alloy of the elements, or in the form of an aluminum-based mother alloy. After the addition operation, the liquid is put into a homogenous form by any suitable agitation or stirring means.

After the addition and agitation or stirring, the segregation operation is carried out, as described in French Pat. No. 1,594,154 namely:

progressive solidification is caused within the volume of liquid metal which is maintained in the vicinity of its melting point in an externally heated vessel, by immersing a cooled body therein;

all the small crystals which are formed are collected at the bottom of the vessel containing the liquid metal;

the small crystals when thus collected are compacted, which displaces the impure intersticial liquid, and the small crystals are "sintered", which gives large crystals; and the purified large-crystal fraction is separated from the fraction which has been enriched in respect of impurities.

The result of the procedure is a metal which is either extremely pure or in which the concentration of troublesome eutectic impurities is much lower than in the starting metal.

It will be appreciated that the above-described process may be carried, out without departing from the scope of the invention, by using segregation processes which are different from that described above. In addition, the invention may be applied to metals other than aluminum, for example, lead and zinc.

By way of example, an aluminum is used which contains about 20 ppm of silicon and 15 ppm of iron. This aluminum may be obtained from a first purification operation by a segregation process. If 200 ppm of iron is added to the aluminum and it is subjected to a fresh segregation operation, it is found that the silicon content can be adjusted to about 5 ppm. As the purification coefficient of iron is markedly higher than that is silicon, the fact that iron is added does not downgrade the quality of the final product but in contrast results in a proportion which is close to the proportion of silicon, with a yield of the order of 70%.

In another example of use, 1000 kg of aluminum is employed, which contains 50 ppm of iron. 500 ppm of copper is added to the aluminum. The aluminum is then subjected to a segregation operation for a period of 14 hours, at the end of which 70% of the mass used is collected in the form of a solid containing close to 60 pm of copper but less than 2 ppm of iron. Such a metal is highly attractive with regard to the production of sheets intended for the manufacture of high and medium voltage electrolytic capacitors, as copper is an element which generally promotes the attainment of high specific capacitances.

It will be seen that the present invention can be used in producing aluminum in a very high state of purity in respect of eutectic elements, and containing in particular less than 10 ppm of iron and silicon. Such aluminum is suitable, in particular, for the production of high and medium voltage capacitors.

I claim:

1. A process for separating a purified metal from a eutectic-containing metal containing the metal to be purified and at least one first eutectic element, wherein the purified metal is separated by melting the eutectic-containing metal, cooling at least a portion of the molten eutectic-containing metal to form small metal crystals and a molten metal containing concentrated impurities, compacting the small metal crystals to form large purified metal crystals, and separating the large purified metal crystals from the metal containing concentrated impurities, the improvement comprising adding at least one second eutectic element to said eutectic-containing metal prior to formation of the small metal crystals.

2. The process of claim 1 wherein the first eutectic element and the second eutectic element are the same element.

3. The process of claim 1 wherein the second eutectic element is added to the impure metal in a hypoeutectic amount.

4. The process of claim 1 wherein said purified metal is about 99.8% pure with respect to the first eutectic element.

5. The process of claim 1 wherein said purified metal is about 99.8% pure with respect to the second eutectic element.

6. A process according to claim 1 wherein said metal to be purified is aluminum.

7. A process according to claim 6 characterized in that the second eutectic element is selected from the group consisting of copper and iron.

8. A process according to claim 7 characterized in that said second eutectic element is iron, the iron being added so as to give a proportion in the molten eutectic-containing metal of from 100 to 500 ppm.

9. A process according to claim 7 characterized in that said second eutectic element is copper, the copper being added so as to give a proportion in the molten eutectic-containing metal of from 100 to 2000 ppm.

10. A process according to claim 7 characterized in that both copper and iron are added to the molten electric-containing metal.

* * * * *